US005132272A

United States Patent [19]

Yoshizawa et al.

[11] Patent Number: 5,132,272

[45] Date of Patent: Jul. 21, 1992

[54] HEAT SENSITIVE RECORDING MATERIAL

[75] Inventors: Katsuaki Yoshizawa, Amagasaki; Ritsuo Mandoh, Sakai; Yukio Takayama, Toyonaka, all of Japan

[73] Assignee: Kanzaki Paper Manufacturing Co., Ltd., Tokyo, Japan

[21] Appl. No.: 648,268

[22] Filed: Jan. 30, 1991

[30] Foreign Application Priority Data

Jan. 31, 1990 [JP] Japan ..... 2-22966

[51] Int. Cl.[5] ..... B41M 5/30

[52] U.S. Cl. ..... 503/217; 503/220; 503/221

[58] Field of Search ..... 503/204, 216, 217, 220, 503/221, 225; 427/151

[56] References Cited

U.S. PATENT DOCUMENTS

| | | | |
|---|---|---|---|
| 4,580,153 | 4/1986 | Kondo et al. | 503/220 |
| 4,641,160 | 2/1987 | Kondo et al. | 503/220 |
| 4,730,057 | 3/1988 | Kanda et al. | 548/524 |
| 4,761,396 | 8/1988 | Kanda et al. | 503/209 |

*Primary Examiner*—Bruce H. Hess
*Attorney, Agent, or Firm*—Armstrong & Kubovcik

[57] ABSTRACT

The present invention provides a heat sensitive recording material comprising a substrate and a recording layer thereon incorporating a colorless or light-colored basic dye and a color acceptor reactive with the dye to form a color when contacted therewith, the recording material being characterized in that, the basic dye comprises (1) at least one compound represented by the formula below [I] and (2) 3-di-n-butylamino-6-methyl-7-anilinofluoran and/or 3-di-n-pentylamino-6-methyl-7-anilinofluoran, and the color acceptor comprises 4,4'-isopropylidenediphenol

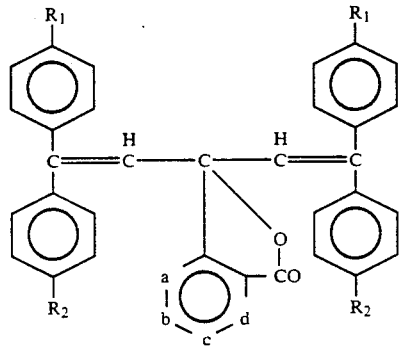

[I]

wherein $R_1$, $R_2$, a, b, c and d are as defined in the specification.

4 Claims, No Drawings

HEAT SENSITIVE RECORDING MATERIAL

The present invention relates to a heat sensitive recording material which has outstanding characteristics for use with optical character- or mark-reading devices having a reading wavelength range over the infrared region.

Various heat sensitive recording materials are proposed which are adapted to record information by contacting, with the use of thermal energy, a colorless or light-colored basic dye with an organic or inorganic electron accepting reactant material for a color forming reaction.

With a trend toward more efficient office work in recent years, optical character-reading devices (OCR, including mark-reading devices) are in greatly increasing use for reading the record images on record media. Particularly, optical character-reading devices having a reading wavelength range over the infrared region are in greatly increasing use. For example, POS (point of sales) system draws the attention as a useful means in market in order to rapidly meet consumer's requirements. In the system, the price tag having a printed character or bar code is read by OCR, and the printed information is computer-treated at the same time of calculation of the price for improving management efficiency. For reading characters are used small and inexpensive devices having a reading wavelength range over the infrared region.

However, the record images (such as black images, blue images, red images, green images, etc.) on the conventional heat sensitive recording material are legible as a reading color by optical character-reading devices having a reading wavelength range over the visible region (400 to 700 nm), but for optical character-reading devices having a reading wavelength range over the infrared region (700 to 900 nm), such images function as drop-out color, irrespective of the color of the image and cannot be read by the devices.

Accordingly, U.S. Pat. Nos. 4,020,056 and 4,107,428 propose the use of a phthalide derivative having two vinyl linkages, and Japanese unexamined patent publication No. 199,757/1984 proposes the use of a phthalide derivative having a fluorene skelton, as a basic dye used for various recording materials suited to optical character-reading devices which utilize near infrared light.

However, the heat sensitive recording material using these basic dyes has tendency to fade in color, and to produce fogging in the background, influenced particularly by heat or humidity due to instability of the dye. As a result, the optical contrast becomes small between the record images and the background. Consequently, it is likely to be misread by optical character-reading devices. Further, the heat sensitive recording material is not necessarily sufficient in color forming ability and whiteness in the visible region.

The above phthalide derivative usually forms green or bluish-black color which is different from black color required for usual heat sensitive recording materials. Accordingly, the fluoran type dye which forms black color is usually used conjointly with the above phthalide derivative to prepare a heat sensitive recording material. However, the fluoran type dye has similar defects and, for example, produces fogging in the background and is apt to lower the record density when exposed to high temperature or high humidity. Consequently, it is impossible to obtain a heat sensitive recording material which is sufficient in whiteness in the visible region and in the recording stability.

An object of the invention is to provide a heat sensitive recording material which is, both in the visible region and infrared region, high in whiteness, excellent in color forming ability and does not lower in whiteness and color density when exposed to high temperature or high humidity.

The above and other objects of the invention will become apparent from the following description.

In the present invention, we have widely investigated a basic dye and a color acceptor contained in a heat sensitive recording layer and we have found the above object is achieved by a conjoint use of, as a basic dye, a specific phthalide derivative and a specific fluoran dye and a combination of a specific color acceptor therewith.

The present invention provides a heat sensitive recording material comprising a substrate and a recording layer thereon incorporating a colorless or light-colored basic dye and a color acceptor reactive with the dye to form a color when contacted therewith, the recording material being characterized in that, the basic dye comprises (1) at least one compound represented by the formula below [I] and (2) 3-di-n-butylamino-6-methyl-7-anilinofluoran and/or 3-di-n-pentylamino-6-methyl-7anilinofluoran, and the color acceptor comprises 4,4'-isopropylidenediphenol

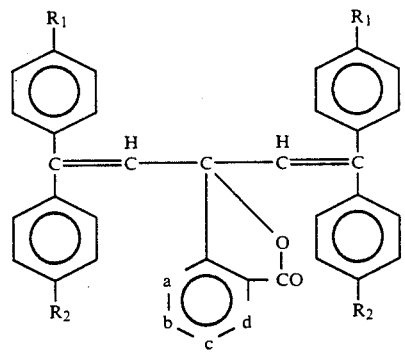

[I]

wherein $R_1$ and $R_2$ are each hydrogen atom; halogen atom; nitro; substituted or unsubstituted, saturated or unsaturated alkyl; substituted or unsubstituted cycloalkyl; substituted or unsubstituted alkoxyl; substituted or unsubstituted acyloxy; substituted or unsubstituted aryl; substituted or unsubstituted aralkyl; substituted or unsubstituted phenoxy; substituted or unsubstituted thioalkoxyl; or $-N(R_3)(R_4)$, $R_3$ and $R_4$ being each hydrogen atom; substituted or unsubstituted, saturated or unsaturated alkyl; substituted or unsubstituted cycloalkyl; substituted or unsubstituted aryl; substituted or unsubstituted aralkyl; tetrahydrofurfuryl; or substituted or unsubstituted acyl, $R_3$ and $R_4$ may form a heteroring together therewith or with an adjacent benzene ring, $R_1$ and $R_2$ are not simultaneously $-N(R_3)(R_4)$, a, b, c and d represent carbon atoms and one or two of them may be nitrogen atom, the carbon atom may have a substituent selected from the group consisting of hydrogen atom; halogen atom; alkyl; alkoxyl; substituted or unsubstituted amino; or nitro, a-b, b-c or c-d bond may form an another aromatic ring.

In the present invention, it is possible to obtain a heat sensitive recording material which is high in whiteness, excellent in color forming ability in the infrared region, low in fogging in the background and small in fading of the record images even when exposed to high temperature or high humidity, and extremely excellent in optical character-reading property, by selectively using the above specific basic dye and color acceptor.

Examples of the basic dye of the formula [I] used in the invention are as follows.

3,3-Bis[1-(4-ethylphenyl)-1-(4-dimethylaminophenyl-)ethylene-2-yl]-4,5,6,7-tetrachlorophthalide, 3,3-bis[1-(4-methylphenyl)-1-(4-pyrrolidinophenyl)ethylene-2-yl]-4,5,6,7-tetrachlorophthalide, 3,3-bis[1-phenyl-1-(4-dibenzylaminophenyl)ethylene-2-yl]-4,5,6,7-tetrachlorophthalide, 3,3-bis[1,1-bis(4-ethoxyphenyl)ethylene-2-yl]-4,5,6,7-tetrabromophthalide, 3,3-bis[1-(4-ethoxyphenyl)-1-(4-methoxyphenyl)ethylene-2-yl]-4,5,6,7-tetrachlorophthalide, 3,3-bis[1-(4-cyclohexylphenyl)-1-(4-pyrrolidinophenyl)ethylene-2-yl]-4,5,6,7-tetrachlorophthalide, 3,3-bis[1-(4-allylphenyl)-1-(4-diethylaminophenyl)ethylene-2-yl]-4,5,6,7-tetrachlorophthalide, 3,3-bis[1-(4-N-tetrahydrofurfuryl-N-methylaminophenyl)-1-(4-ethoxyphenyl)ethylene-2-yl]-6-chloro-4,5,7-tribromophthalide, 3,3-bis[1-(4-β-phenoxyethylphenyl)-1-(4-N-methyl-N-ethylaminophenyl)ethylene-2-yl]-5-nitrophthalide, 3,3-bis[1-(4-β-p-chlorophenoxyethylphenyl)-1-(4-N-methyl-N-ethylaminophenyl)ethylene-2-yl]-6-nitrophthalide, 3,3-bis[1-(4-N-p-chlorophenyl-N-ethylaminophenyl)-1-(4-methylphenyl)ethylene-2-yl]-5-ethoxyphthalide, 3,3-bis[1-(4-methoxyphenyl)-1-(4-pyrrolidinophenyl)ethylene-2-yl]phthalide, 3,3-bis[1-(4-β-dimethylaminoethylaminophenyl)-1-(4-acetylphenyl)ethylene-2-yl]phthalide, 3,3-bis[1-(4-γ-diethylaminopropylaminophenyl)-1-(4-p-ethylbenzoylphenyl)ethylene-2-yl]-4,5,6,7-tetrachlorophthalide, 3,3-bis[1-(4-p-chlorophenylphenyl)-1-(4-phenethylphenyl)ethylene-2-yl]phthalide, 3,3-bis[1-(4-butoxyphenyl)-1-(4-N-cyclohexyl-N-methylaminophenyl)ethylene-2-yl]-4,5,6,7-tetrabromophthalide, 3,3-bis[1-(4-methylmercaptoethylphenyl)-1-(4-diallylaminophenyl)ethylene-2-yl]-5,6-dichloro-4,7-dibromophthalide, 3,3-bis[1-(4-3',3',5'-trimethylcyclohexylphenyl)-1-(4-N-p-methylphenyl-N-ethylaminophenyl)ethylene-2-yl]-4,5,6,7-tetrabromophthalide, 3,3-bis[1-(4-methylmercaptophenyl)-1-(4-N-p-toluoylphenyl-N-2-butenylaminophenyl)ethylene-2-yl]-4,5,6-tribromophthalide, 3,3-bis[1-(4-cyclohexylethylphenyl)-1-(4-N-tetrahydrofurfuryl-N-β-methallylaminophenyl)ethylene-2-yl]-4,5,6,7-tetrachlorophthalide, 3,3-bis[1-(4-3',3'-dimethoxypropylphenyl)-1-(4-N-p-chlorophenyl-N-isopropylaminophenyl)ethylene-2-yl]-5-ethylphthalide, 3,3-bis[1-(4-isoamylphenyl)-1-phenylethylene-2-yl]-4-nitrophthalide, 3,3-bis[1-(4-α-naphthylphenyl)-1-(4-N-3'-methylcyclohexyl-N-acetylaminophenyl)ethylene-2-yl]-4-nitrophthalide, 3,3-bis[1-(4-p-dimethylaminophenylphenyl)-1-(4-morpholinophenyl)ethylene-2-yl]-5-diallylaminophthalide, 3,3-bis[1-(4-isopropoxyphenyl)-1-(4-piperazinophenyl)ethylene-2-yl]-4,5,6,7-tetrachlorophthalide, 3,3-bis[1-(4-bromophenyl)-1-(1-methyl-1,2,3,4-tetrahydroquinoline-6-yl)ethylene-2-yl]-4,5,6,7-tetrachlorophthalide, 3,3-bis[1-(4-isopropoxyphenyl)-1-(2,2,4-trimethyl-1,2-dihydroquinoline-6-yl)ethylene-2-yl]-4,5,6,7-tetrachlorophthalide, 3,3-bis[1-(4-piperidinophenyl)-1-(4-(4-3',5'-dimethylphenoxyphenyl)ethylene-2-yl]phthalide, 3,3-bis[1-phenyl-1-(4-dimethylaminophenyl)ethylene-2-yl]-4,5,6,7-tetrachlorophthalide, 3,3-bis[1-phenyl-1-(4-pyrrolidinophenyl)ethylene-2-yl]-4,5,6,7-tetrachlorophthalide, 3,3-bis[1-(4-methoxyphenyl)-1-(4-dimethylaminophenyl-)ethylene-2-yl]-4,5,6,7-tetrachlorophthalide, 3,3-bis[1-(4-ethoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, 3,3-bis[1-(4-phenoxyphenyl)-1-(4-pyrrolidinophenyl)ethylene-2-yl]-4,5,6,7-tetrachlorophthalide, 3,3-bis[1-(4-ethoxyphenyl)-1-(4-diethylaminophenyl)ethylene-2-yl]-4,5,6,7-tetrachlorophthalide, 3,3-bis[1-(4-butoxyphenyl)-1-(4-piperidinophenyl)ethylene-2-yl]-4,5,6,7-tetrachlorophthalide, 3,3-bis[1-(4-chlorophenyl)-1-(4-hexamethyleneiminophenyl)-ethylene-2-yl]-4,5,6,7-tetrachlorophthalide, 3,3-bis[1-(4-ethoxyphenyl)-1-(4-piperidinophenyl)ethylene-2-yl]-5,6-benzophthalide, 3,3-bis[1-(4-methylphenyl)-1-(julolidine-9-yl)ethylene-2-yl]-4,5,6,7-tetrachlorophthalide, 3,3-bis[1-(4-propoxyphenyl)-1-(4-pyrrolidinophenyl)ethylene-2-yl]-4,7-diazaphthalide, 3,3-bis[1-(4-n-butylphenyl)-1-(4-dimethylaminophenyl)ethylene-2-yl]-5,6-benzo-4,7-diazaphthalide, 3,3-bis[1-(4-ethoxyphenyl)-1-(4-diethylaminophenyl)ethylene-2-yl]-4-azaphthalide, 3,3-bis[1-(4-ethoxyphenyl)-1-(4-piperidinophenyl)ethylene-2-yl]-5-dibutylaminophthalide, 3,3-bis[1-(4-ethoxyphenyl)-1-(4-piperidinophenyl)ethylene-2-yl]-6-diethylaminophthalide, 3,3-bis[1-(4-methoxyphenyl)-1-(4-dimethylaminophenyl)ethylene-2-yl]-6-pyrrolidinophthalide, 3,3-bis[1-(4-N-methyl-N-β-dimethylaminoethylphenyl)-1-(4-fluorophenyl)ethylene-2-yl]-4-azaphthalide, 3,3-bis[1-(4-N-ethyl-N-β-chloroethylaminophenyl)-1-(4-cyclohexyloxyphenyl)ethylene-2-yl]-4-azaphthalide, 3,3-bis[1,1-bis(4-n-butylphenyl)ethylene-2-yl]-4,5,6,7-tetrachlorophthalide, etc.

These phthalide derivatives can be used singly or in mixture of at least two of them. It is preferable to incorporate the phthalide derivative into the recording layer in an amount of 0.01 to 2 g, more preferably 0.05 to 1 g per $m^2$ of the heat sensitive recording material.

Among the above phthalide dertivatives, more preferably used are 3,3-bis[1-(4-methoxyphenyl)-1-(4-dimethylaminophenyl)ethylene-2-yl]-4,5,6,7-tetrachlorophthalide and 3,3-bis-[1-(4-methoxyphenyl)-1-(4-piperidinophenyl)ethylene-2-yl]-4,5,6,7-tetrachlorophthalide, since they are especially excellent in achieving the present desired effects.

In the present invention, it is essential to selectively use, as a basic dye, the above specific phthalide derivative conjointly with at least one fluoran-based dye selected from 3-di-n-butylamino-6-methyl-7-anilinofluoran and 3-di-n-pentylamino-6-methyl-7-anilinofluoran, and as a color acceptor, 4,4'-isopropylidenediphenol.

The proportions of the above phthalide derivative and the specific fluoran-based dye are not particularly limited but can be determined suitably according to the kinds of the phthalide derivative and the purpose contemplated. For example, usually 0.1 to 10 parts by weight, preferably 1 to 5 parts by weight, of the fluoran-based dye is used per part by weight of the phthalide derivative.

Further, the proportions of basic dye and color acceptor are not particularly limited but can be determined suitably according to the kinds of basic dye. For example, usually 1 to 50 parts by weight, preferably 2 to 10 parts by weight, of the color acceptor is used per part by weight of the basic dye.

As stated above, the present invention is characterized by selectively using a specific basic dye and color acceptor, but it is possible to conjointly use an other known basic dye or color acceptor in an amount which does not cause adverse effect.

For preparing a coating composition comprising the foregoing components, the basic dye and the color acceptor are dispersed, together or individually, into water serving as a dispersing medium, using stirring and pulverizing means such as a ball mill, attritor or sand mill.

In the present invention, a binder can be conjointly used in an amount of 2 to 40% by weight, preferably 5 to 25% by weight based on the total solids of the composition. Examples of useful binders are starches, hydroxyethyl cellulose, methyl cellulose, carboxymethyl cellulose, gelatin, casein, gum arabic, polyvinyl alcohol, acetoacetylated polyvinyl alcohol, diisobutylene-maleic anhydride copolymer salt, styrene-maleic anhydride copolymer salt, ethyleneacrylic acid copolymer salt, styrene-acrylic acid copolymer salt, urea resin, melamine resin, amide resin, styrenebutadiene copolymer emulsion, etc.

Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as benzophenone compounds, defoaming agents, fluorescent dyes, coloring dyes, etc.

Further, to the composition may be added zinc stearate, calcium stearate, polyethylene wax, carnauba wax, paraffin wax, ester wax or like waxes; kaolin, clay, talc, calcium carbonate, calcined kaolin, titanium dioxide, kieselguhr, finely divided anhydrous silica, activated clay or like inorganic pigment. A sensitizer may also be used depending on the purpose. Examples of useful sensitizers are stearic acid amide, stearic acid methylenebisamide, oleic acid amide, palmitic acid amide, coconut fatty acid amide or like fatty acid amides, 2,2'-methylenebis(4-methyl-6-tert-butylphenol), 4,4'-butylidenebis(6-tert-butyl-3-methylphenol), 2,2'-methylene-bis(4-ethyl-6-tert-butylphenol), 2,4-di-tert-butyl-3-methylphenol) or like hindered phenols, 2-(2'-hydroxy-5'-methylphenyl)benzotriazole, 2-hydroxy-4-benzyloxybenzophenone, 1,2-di(3-methylphenoxy)ethane, 1,2-diphenoxyethane, 1-phenoxy-2-(4-methylphenoxy)ethane, 4-methoxyphenoxy-2-methylphenoxyethane, dimethyl terephthalate, dibutyl terephthalate, dibenzyl terephthalate, dibutyl isophthalate, phenyl 1-hydroxynaphthoate, and various known heat-fusible materials.

The amount of the sensitizer is not particularly limited and is preferably up to 4 parts by weight per one part by weight of the color acceptor.

In the present heat sensitive recording material, the method of forming the recording layer is not particularly limited. For example, the coating compositions applied to a substrate by an air knife coater, variable-bar blade coater, pure blade coater, short dwell coater or like suitable means and dried. The amount of coating composition to be applied, which is not limited particularly, is usually 2 to 12 g/m$^2$, preferably 3 to 10 g/m$^2$, based on dry weight.

As the substrate is used paper, synthetic fiber paper, synthetic resin film or the like, but paper is most preferable in view of cost, coating suitability and the like.

As required, it is possible to enhance the preservability by providing a protective layer on the recording layer or on the rear surface of the heat sensitive recording material. Moreover, various known techniques in the field of heat sensitive recording material, such as provision of an undercoat layer to the substrate, can be employed. An adhesive layer can be provided on the rear surface of the substrate to obtain an adhesive label.

The invention will be described below in more detail with reference to Examples without limiting the scope thereof so far as not beyond the spirit of the invention. In the Examples, parts and percentages are all by weight, unless otherwise specified.

EXAMPLE 1

(1) Composition (A)

| | |
|---|---|
| 3,3-Bis[1-(4-methoxyphenyl)-1-(4-dimethylamino-phenyl)ethylene-2-yl]-4,5,6,7-tetrachlorophthalide | 4 parts |
| 3-Di-n-butylamino-6-methyl-7-anilinofluoran | 10 parts |
| 5% Aqueous solution of methyl cellulose | 5 parts |
| Water | 40 parts |

These components were pulverized by a sand mill to prepare Composition (A) having an average particle size of 3 μm.

(2) Composition (B)

| | |
|---|---|
| 4,4'-Isopropylidenediphenol | 30 parts |
| 5% Aqueous solution of methyl cellulose | 5 parts |
| Water | 55 parts |

These components were pulverized by a sand mill to prepare Composition (B) having an average particle size of 3 μm.

(3) Composition (C)

| | |
|---|---|
| 1,2-Di(3-methylphenoxy)ethane | 20 parts |
| 5% Aqueous solution of methyl cellulose | 5 parts |
| Water | 55 parts |

These components were pulverized by a sand mill to prepare Composition (C) having an average particle size of 3 μm.

(4) Preparation of a recording layer

A coating composition was prepared by mixing with stirring 59 parts of Composition (A), 90 parts of Composition (B), 80 parts of Composition (C), 15 parts of finely divided anhydrous silica (oil absorption 180 ml/100 g), 30 parts of 20% aqueous solution of oxidized starch and 10 parts of water. The coating composition was applied to a paper substrate weighing 100 g/m$^2$ in an amount of 5 g/m$^2$ by dry weight to prepare a heat sensitive recording paper.

EXAMPLE 2

A heat sensitive recording paper was prepared in the same manner as in Example 1 except that 4 parts of 3,3-bis[1-(4-methoxyphenyl)-1-(4-pyrrolidinophenyl-)ethylene-2-yl]-4,5,6,7-tetrachlorophthalide was used in place of 4 parts of 3,3-bis[1-(4-methoxyphenyl)-1-(4-dimethylaminophenyl)ethylene-2-yl]-4,5,6,7-tetrachlorophthalide in the preparation of Composition (A).

EXAMPLE 3

A heat sensitive recording paper was prepared in the same manner as in Example 1 except that 4 parts of 3,3-bis[1-(4-ethoxyphenyl)-1-(4-methoxyphenyl)ethylene-2-yl]-4,5,6,7-tetrachlorophthalide was used in place of 4 parts of 3,3-bis[1-(4-methoxyphenyl)-1-(4-dimethylaminophenyl)ethylene-2-yl]-4,5,6,7-tetrachlorophthalide in the preparation of Composition (A).

EXAMPLE 4

A heat sensitive recording paper was prepared in the same manner as in Example 1 except that 10 parts of 3-di-n-pentylamino-6-methyl-7-anilinofluoran was used in place of 10 parts of 3-di-n-butylamino-6-methyl-7-anilinofluoran in the preparation of Composition (A).

COMPARISON EXAMPLE 1

A heat sensitive recording paper was prepared in the same manner as in Example 1 except that 10 parts of 3-(N-ethyl-N-isoamylamino)-6-methyl-7-anilinofluoran was used in place of 10 parts of 3-di-n-butylamino-6-methyl-7-anilinofluoran in the preparation of Composition (A).

COMPARISON EXAMPLE 2

A heat sensitive recording paper was prepared in the same manner as in Example 1 except that 30 parts of 4,4'-cyclohexylidenebisphenol was used in place of 30 parts of 4,4'-isopropylidenediphenol in the preparation of Composition (B).

COMPARISON EXAMPLE 3

A heat sensitive recording paper was prepared in the same manner as in Example 1 except that 30 parts of 4-hydroxy-4'-isopropyloxydiphenylsulfone was used in place of 30 parts of 4,4'-isopropylidenediphenol in the preparation of Composition (B).

COMPARISON EXAMPLE 4

A heat sensitive recording paper was prepared in the same manner as in Example 1 except that 4 parts of 3,3-bis[1,1-bis(4-pyrrolidinophenyl)ethylene-2-yl]-5,6-dichloro-4,7-dibromophthalide was used in place of 4 parts of 3,3-bis[1-(4-methoxyphenyl)-1-(4-dimethylaminophenyl)ethylene-2-yl]-4,5,6,7-tetrachlorophthalide in the preparation of Composition (A).

The obtained eight kinds of the heat sensitive recording materials were checked for quality by the below-mentioned methods and the results were given in Table 1.

Whiteness

Each of the heat sensitive recording materials is checked for whiteness with use of a Hunter multipurpose reflectometer.

Fogging in the background area

After treated at 40° C., 50% RH for 48 hours, each of the heat sensitive recording materials is checked for whiteness with use of a Hunter multipurpose reflectometer.

Resistance to heat over the near infrared region

Each of the heat sensitive recording materials is pressed to a plate heated at 120° C. at a pressure of 4 kg/cm$^2$ for 5 seconds to produce record images. After being treated at 60° C. for 48 hours, the record images and the surrounding background area were checked for reflectivity (%) at 830 nm with use of a spectrophotometer to obtain PCS (Print Contrast Signal) value.

PCS value is calculated by the following equation.

$$PCS \text{ value} = \frac{A - B}{A}$$

A; reflectivity of the background area

B; reflectivity of the recorded (colored) area

PCS value required for the record images is not determined depending on the kinds of optical character-reading device, but is usually 0.7 to 1.0, preferably 0.75 to 1.0 in the reading wavelength range.

Resistance to humidity over the near infrared region

The recording material obtained after pressed to a plate as above is allowed to stand at 50° C., 75% RH for 48 hours. Thereafter PCS value is calculated similarly to the above.

Color density over the near infrared region

The record images printed by use of a thermal printer (Texas Instruments Inc., Model PC-100A) are checked for reflectivity (%) at 830 nm with use of a spectrophotometer. The smaller the value of the reflectivity, the higher the color density.

TABLE 1

| | whiteness (%) | fogging (%) | heat resistance (PCS) | humidity resistance (PCS) | color density (%) |
|---|---|---|---|---|---|
| Ex. | | | | | |
| 1 | 78.5 | 77.8 | 0.80 | 0.76 | 13 |
| 2 | 79.0 | 78.0 | 0.82 | 0.78 | 12 |
| 3 | 77.0 | 76.1 | 0.75 | 0.75 | 13 |
| 4 | 78.1 | 77.5 | 0.81 | 0.76 | 13 |
| Com. Ex. | | | | | |
| 1 | 76.0 | 72.3 | 0.79 | 0.75 | 13 |
| 2 | 78.3 | 77.5 | 0.60 | 0.51 | 16 |
| 3 | 78.4 | 77.6 | 0.58 | 0.55 | 30 |
| 4 | 75.1 | 72.0 | 0.55 | 0.50 | 12 |

As apparent from the results in Examples, the present heat sensitive recording material is high in whiteness, excellent in color density over the near infrared region, maintains high PCS value even when exposed to high temperature or high humidity, and extremely small in fogging in the background area, hence is high in commercial value.

We claim:

1. A heat sensitive recording material comprising: a substrate and a recording layer disposed thereon, the recording layer comprising:

(a) a colorless or light-colored basic dye comprising (i) at least one member of the group consisting of 3,3-bis[1-(4-methoxyphenyl)-1-(4-dimethylaminophenyl)ethylene-2-yl]-4,5,6,7-tetrachlorophthalide and 3,3-bis[1-(4-methoxyphenyl)-1-(4-pyrrolidinophenyl)ethylene-2-yl]-4,5,6,7-tetrachlorophythalide and (ii) at least one member of the group consisting of 3-di-n-butylamino-6-methyl-7-anilinofluoran and 3-di-n-pentylamino-6-methyl-7-anilinofluoran; and (b) a color acceptor reactive with the dye to form a color upon contact with the dye, the color acceptor comprising 4,4'-isopropylidenediphenol.

2. A heat sensitive recording material as defined in claim 1 wherein the compound of the formula [I] is incorporated into the recording layer in an amount of 0.01 to 2 g per m$^2$ of the heat sensitive recording material.

3. A heat sensitive recording material as defined in claim 1 wherein the fluoran compound is used in an amount of 0.1 to 10 parts by weight per part by weight of the compound of the formula [I].

4. A heat sensitive recording material as defined in claim 1 wherein the color acceptor is used in an amount of 1 to 50 parts by weight per part by weight of the basic dye.

* * * * *